United States Patent [19]

Leworthy

[11] 4,112,284

[45] Sep. 5, 1978

[54] FALL-THROUGH RETURN SPRING ARRANGEMENT FOR A PUSH-BUTTON SWITCH MECHANISM

[75] Inventor: John Harwood Leworthy, Newton Aycliffe, England

[73] Assignee: The General Electric Company Limited, London, England

[21] Appl. No.: 716,155

[22] Filed: Aug. 20, 1976

[30] Foreign Application Priority Data

Aug. 22, 1975 [GB] United Kingdom ..... 34934/75

[51] Int. Cl.[2] ..... H01H 3/12

[52] U.S. Cl. ..... 200/340

[58] Field of Search ..... 200/67 C, 76, 77, 159 R, 200/159 A, 159 B, 276, 340, 153 S

[56] References Cited

U.S. PATENT DOCUMENTS

| | | | |
|---|---|---|---|
| 3,433,914 | 3/1969 | Ericsson | 200/159 A |
| 3,715,545 | 2/1973 | Long | 200/159 A |
| 3,895,203 | 7/1975 | Leworthy | 200/159 R X |
| 3,920,943 | 11/1975 | Lapointe | 200/159 R |
| 3,993,884 | 11/1976 | Kondur et al. | 200/340 X |

*Primary Examiner*—James R. Scott

*Attorney, Agent, or Firm*—Kirschstein, Kirschstein, Ottinger & Cobrin

[57] ABSTRACT

A push-button switch has a wire spring to return the push-button to its non-operated position after operation. The spring is carried by the stem on which the button is mounted and a portion of the spring bears against a fixed ramp. The ramp has first and second portions, the second portion being inclined at a smaller angle to the direction of motion of the push-button than the first portion, against which the spring bears in succession during operation of the push-button such that the force necessary to move the push-button decreases as the push-button is depressed so as to effect a "fall-through" action.

7 Claims, 4 Drawing Figures

FALL-THROUGH RETURN SPRING ARRANGEMENT FOR A PUSH-BUTTON SWITCH MECHANISM

BACKGROUND OF THE INVENTION

The present invention relates to push-button switch mechanisms.

According to the present invention in a push-button switch mechanism in which one or more electric contacts are actuated upon substantially linear movement of a push-button relative to a support or housing, there are provided on or secured to the push-button or the housing means presenting a ramp or cam surface having portions inclined at different angles to the direction of the linear movement, and resillient means on or secured to the housing or the push-button respectively, which resilient means bears successively upon the differently inclined portions of the ramp surface during the linear movement such as to provide a restoring force for the push-button which initially increases as the push-button is depressed and then decreases.

Preferably there are provided two ramp surfaces disposed symmetrically about the centre line of action of the push-button on a body formed integrally with or secured to the housing, and the resilient means comprises either a single spring or two separate springs secured to or carried by the push-button. The push-button may comprise a stem portion, which is slidably mounted in the housing and on which the spring or springs is or are carried, and a cap portion by means of which the push-button is actuated.

BRIEF DESCRIPTION OF THE DRAWINGS

A push-button mechanism in accordance with the present invention will now be described by way of example with reference to the accompanying drawings, of which.

DESCRIPTION OF THE PREFERRED EMBODIMENT

Figure 1:
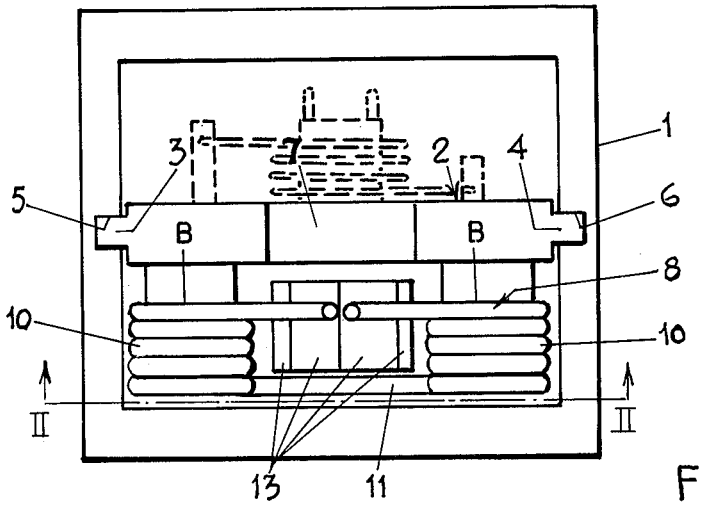
FIG. 1 shows a plan view of part of one form of the mechanism.
Figure 2:
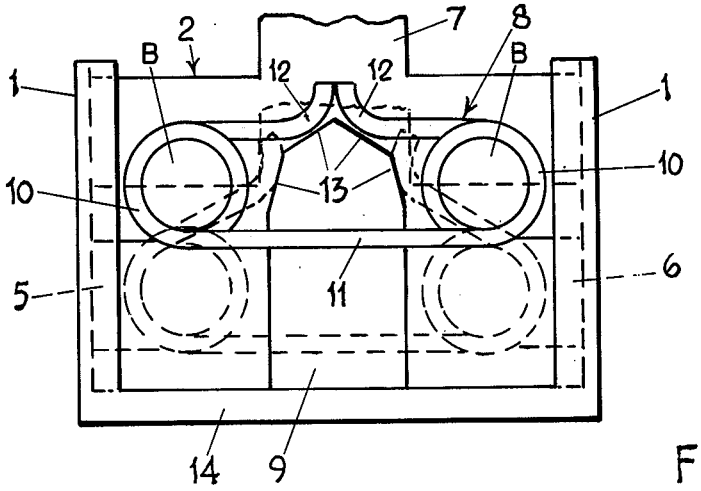
FIG. 2 shows a part-section view on the line II—II of the part shown in FIG. 1.

Referring first to FIGS. 1 and 2 the mechanism comprises a rectangular box-like housing 1 in which a generally planar stem 2 of a push-button is slidably mounted by means of tongues 3 and 4 which rest in grooves 5 and 6 in opposed inner faces of the housing 1. The cap (not shown) of the push-button is attached to the upper end of a portion 7 of the push-button. The stem 2 divides the interior of the housing 1 into two chambers, one of which houses the electric contacts (not shown) of the push-button mechanism while the other houses a return spring arrangement comprising a wire spring 8 and a pillar 9. The spring 8 comprises two coils 10 surrounding respective circular-section bosses B projecting from the stem 2, the two coils being interconnected by a straight portion 11 and having curved free ends 12 which rest upon ramp-like faces 13 at the upper end of the pillar 9. The pillar 9 may be formed integrally with the base 14 of the housing 1 or may be secured to it.

The electric contacts (not shown) of the mechanism are actuated by depressing the cap (not shown) such that the stem 2 of the push-button and the spring 8 move downwards towards the base 14 of the housing 1 from the rest position (full-line) to the fully depressed position (dashed-line) as shown in FIG. 2. The electric contacts may comprise two contacts that are fixed in relation to the housing 1 and a moving contact carried on or coupled to the stem 2 such that the moving contact interconnects the two fixed contacts when the push-button cap and the stem 2 are depressed.

Figure 3:
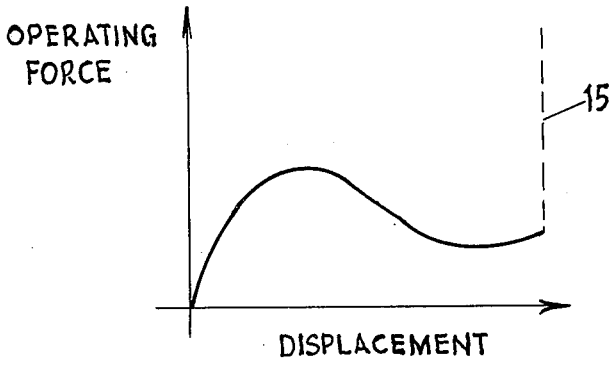
FIG. 3 shows a curve illustrating the operation of the mechanism.

Referring also to FIG. 3, as the downward displacement of the push-button commences the operating force required to depress the push-button rises, as the coils 10 of the spring 8 are distorted. When the points of contact between the spring portions 12 and the ramp faces 13 reach the points at which the change of slope of the faces 13 occurs the operating force begins to fall due to the increase in the effective lengths of the portions 12 and the change in the angle at which the spring forces are applied to the faces 13. Once the points of contact are fully on the steeper portions of the faces 13 the operating force begins to rise once more, but at a lower rate than the initial rise, until the push-button reaches the end of its travel, indicated by the dashed line 15 in FIG. 3. The decrease in operating force over part of the displacement provides the push-button with a so-called "fall-through" action which results in a more recognisable and definite actuation of the mechanism than with a steadily increasing operating force.

It will be appreciated that the spring 8 could take other forms and could comprise two separate mirror-image parts. The pillar 9 could be secured to the stem 2 of the push-button and the spring 8 to the housing, that is the converse of the arrangement shown in FIGS. 1 and 2, the pillar and spring being inverted compared with the arrangement of FIG. 2 to provide the same fall-through action. The restoring force for the push-button, which constitutes a major part of the operating force, is of course provided by that component of the spring pressure on the faces 13 which aligns with the direction of motion of the stem 2 of the push-button.

Figure 4:
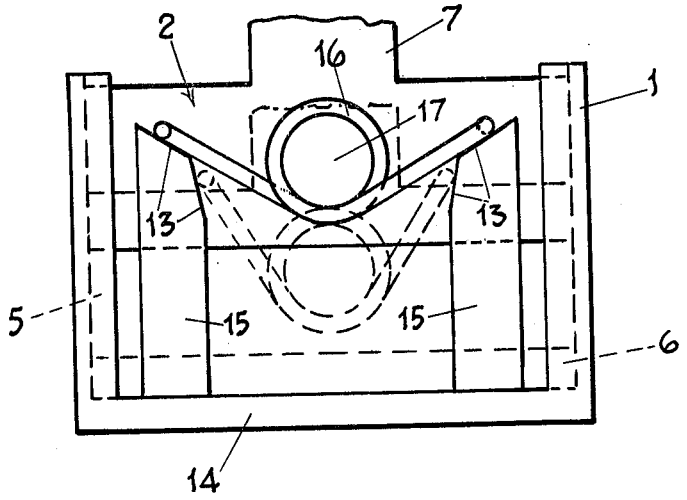
FIG. 4 shows a part-sectional view of an alternative form of the mechanism.

Referring now to FIG. 4, in an alternative form of mechanism the pillar 9 is replaced by two pillars 15, the ramp surfaces 13 being on the inward-facing sides of these pillars, and the double-coil spring 8 is replaced by a single-coil spring 16 centrally mounted on the stem 2 on a boss 17. The principle of operation is similar to that of the mechanism shown in FIGS. 1 and 2, but the single-coil arrangement gives more consistent "fall-through" action under adverse tolerance conditions.

The electric contacts of the push-button mechanism described above may be of the form described in U.S. Pat. No. 3,895,203, the coil spring moving contact described in that patent being mounted on the major face of the stem 2 remote from the return spring 8, as shown in dashed outline in FIG. 1, and the fixed contacts being mounted generally in the plane of the base 14.

I claim:

1. A push-button switch mechanism for linearly actuating a set of switch contacts, said switch mechanism including:

(A) a housing, (B) a push button, (C) means mounting said push-button for substantially linear motion with respect to said housing, and (D) a return-spring arrangement to provide substantially the sole restoring force acting between the push-button and the housing and tending to reverse said linear motion, said arrangement consisting of:

(I) a first means presenting a ramp surface having a first portion inclined at a first angle to said direction of motion and a second portion inclined to said direction of motion at a smaller angle than said first angle, and (II) second means including a spring of which part is arranged to bear successively during said linear motion firstly upon said first portion of said ramp surface to provide an increasing restoring force as said linear motion progresses and secondly upon the second portion of said ramp surface to provide a lesser value of restoring force due to a smaller angle at which said second portion is inclined to said direction of motion, one of said first and second means being secured to said push-button and the other of said first and second means being secured to said housing.

2. A push-button switch mechanism in accordance with claim 1 wherein there are provided two ramp surfaces disposed symmetrically about the center line of action of said push-button.

3. A push-button switch mechanism in accordance with claim 2 wherein said ramp surfaces are formed on opposite sides of a body secured to said housing.

4. A push-button switch mechanism in accordance with claim 2 wherein said ramp surfaces are formed on respective bodies which are disposed one either side of said centre line of action of said push-button and which are secured to said housing.

5. A push-button switch mechanism in accordance with claim 1 wherein said resilient means comprises a single wire spring carried by said push-button.

6. A push-button mechanism in accordance with claim 2 wherein said second means comprises two separate wire springs carried by said push-button, each of said springs bearing on a respective one of said ramp surfaces.

7. A push-button mechanism in accordance with claim 1 wherein said push-button comprises a stem portion which is slidably mounted in said housing and a cap portion by means of which said push-button is actuated.

* * * * *